US010982635B2

(12) United States Patent
Harcombe et al.

(10) Patent No.: US 10,982,635 B2
(45) Date of Patent: Apr. 20, 2021

(54) FUEL INJECTOR AND METHOD FOR CONTROLLING THE SAME

(71) Applicant: DELPHI TECHNOLOGIES IP LIMITED, St. Michael (BB)

(72) Inventors: Anthony Thomas Harcombe, Richmond (GB); George A. Meek, Aylburton (GB)

(73) Assignee: DELPHI TECHNOLOGIES IP LIMITED

( * ) Notice: Subject to any disclaimer, the term of this patent is extended or adjusted under 35 U.S.C. 154(b) by 397 days.

(21) Appl. No.: 15/724,587

(22) Filed: Oct. 4, 2017

(65) Prior Publication Data

US 2018/0045153 A1 Feb. 15, 2018

Related U.S. Application Data

(63) Continuation-in-part of application No. 14/404,080, filed as application No. PCT/EP2013/059511 on May 7, 2013, now abandoned.

(30) Foreign Application Priority Data

May 29, 2012 (EP) ..... 12169828

(51) Int. Cl.
*F02M 47/02* (2006.01)
*F02M 63/00* (2006.01)
(Continued)

(52) U.S. Cl.
CPC ..... *F02M 47/027* (2013.01); *F02D 41/38* (2013.01); *F02D 41/3827* (2013.01);
(Continued)

(58) Field of Classification Search
CPC .... F02M 47/027; F02M 69/38; F02M 69/383; F02M 63/0215; F02M 63/0017; F02M 55/002; F02M 63/0007; F02D 41/3827
(Continued)

(56) References Cited

U.S. PATENT DOCUMENTS 6,405,941 B2 6/2002 Ganser
6,471,142 B1 * 10/2002 Lambert ..... F02M 45/08 239/88

(Continued)

FOREIGN PATENT DOCUMENTS

DE 102007000379 A1 1/2008

*Primary Examiner* — Joseph A Greenlund
(74) *Attorney, Agent, or Firm* — Joshua M. Haines

(57) ABSTRACT

A fuel injector includes a nozzle having at least one nozzle outlet. A valve needle is moveable with respect to a valve needle seating through a range of movement between a closed position and an open position to control fuel delivery through the at least one nozzle outlet. The movement of the nozzle needle is controlled by fuel pressure within a control chamber. The injector has first and second nozzle control valves for controlling fuel flow into and out of the control chamber to pressurise and depressurise the control chamber, respectively. The first nozzle control valve can operate selectively to place the control chamber in fluid communication with a fuel drain or to place the control chamber in fluid communication with a high pressure supply line. The second nozzle control valve can operate selectively to place the control chamber in fluid communication with a fuel drain.

12 Claims, 5 Drawing Sheets

(51) Int. Cl.
*F02M 63/02* (2006.01)
*F02D 41/38* (2006.01)

(52) U.S. Cl.
CPC .... *F02M 63/0007* (2013.01); *F02M 63/0063* (2013.01); *F02M 63/0215* (2013.01); *F02M 63/0017* (2013.01)

(58) Field of Classification Search
USPC ..... 239/5, 94, 96
See application file for complete search history.

(56) References Cited

U.S. PATENT DOCUMENTS 6,499,465 B1 * 12/2002 Mahr ..... F02M 41/16 123/447
6,536,416 B1 * 3/2003 Mahr ..... F02M 45/00 123/447
6,629,647 B2 * 10/2003 Boecking ..... F02M 47/02 239/533.2
6,761,325 B2 7/2004 Baker et al.
6,820,594 B2 11/2004 Rodriguez-Amaya et al.
6,892,955 B2 * 5/2005 Grabandt ..... F02M 47/027 123/445
6,981,653 B2 1/2006 Boehland
7,111,614 B1 * 9/2006 Coldren ..... F02M 45/02 123/299
7,198,203 B2 * 4/2007 Brenk ..... F02M 45/02 123/299
7,506,635 B2 * 3/2009 Omae ..... F02M 63/0015 123/467
9,157,400 B2 10/2015 Harcombe et al.
9,376,992 B2 * 6/2016 Brown ..... F02M 21/0263
9,863,385 B2 * 1/2018 Graham ..... F02M 47/02
2002/0070295 A1 * 6/2002 Baker ..... F02M 45/086 239/533.3
2002/0088435 A1 * 7/2002 Kropp ..... F02M 47/027 123/446
2002/0170537 A1 * 11/2002 Reusing ..... F02M 63/0026 123/446
2002/0185111 A1 * 12/2002 Boecking ..... F02M 47/027 123/446
2003/0098015 A1 * 5/2003 Potschin ..... F02M 63/004 123/446
2003/0111053 A1 * 6/2003 Grabandt ..... F02M 47/02 123/446
2004/0055573 A1 * 3/2004 Boecking ..... F02M 63/0026 123/446
2004/0074478 A1 * 4/2004 Potschin ..... F02M 63/0026 123/446
2004/0134465 A1 * 7/2004 Boltz ..... F02M 57/025 123/446
2004/0169092 A1 * 9/2004 Boehland ..... F02M 45/04 239/88
2005/0263133 A1 * 12/2005 Magel ..... F02M 59/105 123/446
2006/0202053 A1 * 9/2006 Gibson ..... F02M 63/0063 239/88
2008/0041977 A1 * 2/2008 Hotta ..... F02M 69/383 239/533.12
2008/0265054 A1 * 10/2008 Buehler ..... F02M 47/027 239/88
2009/0126689 A1 * 5/2009 Gibson ..... F02M 47/027 123/446
2009/0165749 A1 * 7/2009 Ibrahim ..... F02M 63/0015 123/472
2010/0133361 A1 * 6/2010 Futonagane ..... F02M 63/0225 239/533.12
2010/0200679 A1 * 8/2010 Haba ..... F02D 41/38 239/584
2012/0097132 A1 * 4/2012 Suda ..... F02D 41/065 123/457
2012/0174893 A1 * 7/2012 Harcombe ..... F02M 61/20 123/446
2013/0153686 A1 * 6/2013 Keeler ..... F02M 47/027 239/584
2014/0203112 A1 * 7/2014 Holtman ..... F02M 63/0075 239/585.1
2015/0167609 A1 * 6/2015 Harcombe ..... F02M 61/042 239/5
2017/0276112 A1 * 9/2017 Millet ..... F02M 45/12
2018/0045153 A1 * 2/2018 Harcombe ..... F02M 47/027

* cited by examiner

FUEL INJECTOR AND METHOD FOR CONTROLLING THE SAME

CROSS-REFERENCE TO RELATED APPLICATIONS

This patent application is a continuation-in-part application of U.S. patent application Ser. No. 14/404,080 filed on Nov. 26, 2014, which is a national stage application under 35 U.S.C. 371 of PCT Application No. PCT/EP2013/059511 having an international filing date of 7 May 2013, which is designated in the United States and which claimed the benefit of European Patent Application No. 12169828.6 filed on May 29, 2012, the entire disclosures of each are hereby incorporated herein by reference.

TECHNICAL FIELD OF INVENTION

The present invention relates to a fuel injector for an internal combustion engine. The invention also relates to a method of operating a fuel injector; and a control system for a fuel injector.

BACKGROUND OF INVENTION

To optimise diesel engine combustion, it is necessary to have precise control over the quantities of fuel delivered by the fuel injectors. It is desirable to be able to inject small quantities of fuel across a wide range of fuel pressures. Typically, a fuel injector includes an injection nozzle having a nozzle needle which is movable towards and away from a nozzle needle seating so as to control fuel injection into the engine. The nozzle needle is controlled by means of a nozzle control valve, which controls fuel pressure in a control chamber for the nozzle needle.

A common rail injection system provides a high pressure fuel supply to a plurality of fuel injectors. With existing common rail injection systems it is necessary to make compromises in order to fine tune performance for emissions and controllability. Sometimes "square" injection rates are required to ensure maximum pressure energy is converted into spray energy. Other times a slower rate is required for accurate quantity control or to ensure an optimum spray mixing rate.

One approach is to adjust the flow rates of the control orifices or equivalent restrictions during the design and development of individual applications. The main influence of this adjustment is to control the needle opening velocity. With some concepts this can have detrimental influences on needle closing rate or minimum injection pressure. This approach requires individual development programmes for each different application.

An alternative approach uses an amplifier piston that can be switched when required to provide high injection rates in addition to providing a low injection rate when not switched. The very high flow rates needed to power the amplifier and the large control valve required make these systems inefficient, large and expensive.

The present invention sets out to help ameliorate or overcome at least some of the problems associated with prior art systems.

SUMMARY OF THE INVENTION

Aspects of the present invention relate to a fuel injector; a method of operating a fuel injector; and a control system for a fuel injector.

In a further aspect, the present invention relates to a fuel injector for use in delivering fuel to an internal combustion engine, the fuel injector comprising: a nozzle having a valve needle which is moveable with respect to a valve needle seating through a range of movement between a closed position and an open position to control fuel delivery through at least one nozzle outlet, whereby movement of the nozzle needle is controlled by fuel pressure within a control chamber; and first and second nozzle control valves for controlling fuel flow into and out of the control chamber to pressurise and depressurise the control chamber; wherein said first nozzle control valve is operable selectively to place the control chamber in fluid communication with a fuel drain; said first nozzle control valve also being operable selectively to place the control chamber in fluid communication with a high pressure supply line; and said second nozzle control valve being operable selectively to place the control chamber in fluid communication with a fuel drain.

The first and second nozzle control valves are connected to the needle control chamber. A range of configurations are possible, including configurations to meet multiple injection requirements. The present invention provides flexibility to suit a range of applications and can provide a balance between reduced static leaks (potentially statically leakless) and complexity. At least in certain embodiments, the present invention can enable the needle opening velocity to be controlled for a specific injection event, for example as part of a multiple injection chain, at key operating points within an application, or to allow different characteristics across applications.

The present invention can in certain embodiments provide a high needle opening velocity suitable for delivering "square" injection rates to provide high spray energy and improved hydraulic efficiency. The present invention in certain embodiments can also provide a low needle opening rate suitable for delivering slower mixing for a particular combustion mode or for pilot and post injection when accurate quantity control is important. The low opening velocity can also be used to prevent spray over penetration of the late post injections used for after treatment control.

The first and second nozzle control valves can be actuated independently of each other. This allows improved control in comparison to prior art arrangements, particularly in needle damping, high or low damping, and combinations of damping rates. The second nozzle control valve can be operable independently of the first nozzle control valve selectively to place the control chamber in fluid communication with a fuel drain. Thus, at least in certain embodiments, either the first nozzle control valve or the second nozzle control valve can be operated to place the control chamber in fluid communication with the fuel drain.

The first nozzle control valve and/or the second nozzle control valve can be selectively operated to place the control chamber in fluid communication with a low pressure fuel drain. The fuel collected in the fuel drain can be returned to a fuel tank for the vehicle. The fuel drain can comprise one or more drain passages for supplying fuel to a reservoir. The drain passages can be separate from each other or in communication with each other.

The first nozzle control valve can be in fluid communication with the control chamber via a first restricted pathway. The second nozzle control valve can be in fluid communication with the control chamber via a second restricted pathway. The first restricted pathway can comprise a first restriction for controlling the flow rate through the first restricted pathway. The second restricted pathway can comprise a second restriction for controlling the flow rate through the second restricted pathway. The cross-sectional areas of the first and second restrictions can be the same or different. The cross-sectional area of the first restriction can be smaller or larger than the cross-sectional area of the second restriction. For example, the cross-sectional area of the first restriction can be between half and twice the area of the second restriction. Providing different cross-sectional areas allows the speed of the valve needle to be controlled by selectively operating the first and second nozzle control valves. In particular, three different operating speeds can be implemented by opening the first nozzle control valve, the second nozzle control valve or both the first and second nozzle control valves. The restricted pathways can be formed by a bore having an appropriate diameter.

The first nozzle control valve can be in fluid communication with the high pressure supply line via a first restricted inlet pathway. The second nozzle control valve can be in fluid communication with the high pressure supply line via a second restricted inlet pathway. The first restricted inlet pathway and/or the second restricted inlet pathway can control filling of the control chamber. By controlling (or throttling) the supply of high pressure fuel to said first nozzle control valve and/or said second nozzle control valve, the filling of the control chamber can be controlled without compromising the drainage functionality.

The first nozzle control valve can be a two-way valve, or a three-way valve. The first nozzle control valve can be a balanced valve, or an unbalanced valve. The second nozzle control valve can be a two-way valve, or a three-way valve. The first nozzle control valve can be a balanced valve, or an unbalanced valve.

The first nozzle control valve can be configured to operate as a fill valve and optionally also a drain valve. The first nozzle control valve can be selectively operated to place the control chamber in fluid communication with a high pressure supply line. The second nozzle control valve can also be selectively operated to place the control chamber in fluid communication with a high pressure supply line. Alternatively, the second nozzle control can function as a drain valve which is not in communication with a high pressure supply line.

The control chamber can be continuously in fluid communication with a high pressure supply line, for example via a third restricted pathway. The third restricted pathway can have a third restriction for controlling the flow rate from the high pressure supply line to the control chamber. The first nozzle control valve and/or the second nozzle control valve can be operable to place the high pressure supply line in fluid communication with the fuel drain. The communication between the high pressure supply line and the fuel drain can be via the third restricted pathway.

The first and second nozzle control valves can each comprise an actuator, such as an electro-mechanical solenoid or a piezo actuator. The first and second nozzle control valves can comprise respective first and second solenoids. The first and second solenoids can be energized to actuate the respective first and second nozzle control valves.

The injector can also comprise a filling valve for controlling the supply of fuel from a high pressure supply line. The filling valve can be selectively operated to place a high pressure supply line in fluid communication with the control chamber. The filling valve could be actuated independently of the first and second nozzle control valves. Alternatively, the filling valve can be operable in response to the first nozzle control valve. A spring can be provided to bias the filling valve to a closed position.

The filling valve can be provided between the first nozzle control valve and the first restricted pathway. The filling valve can comprise a third restricted pathway for providing continuous fluid communication between the high pressure supply line and the first nozzle control valve. Operating the first nozzle control valve can selectively establish communication between the high pressure supply line and the fuel drain.

The filling valve described herein is believed to be patentable independently. In a further aspect, the present invention relates to a fuel injector for use in delivering fuel to an internal combustion engine, the fuel injector comprising: a nozzle having a valve needle which is moveable with respect to a valve needle seating through a range of movement between a closed position and an open position to control fuel delivery through at least one nozzle outlet, whereby movement of the nozzle needle is controlled by fuel pressure within a control chamber; a first nozzle control valve for controlling fuel flow into and out of the control chamber to pressurise and depressurise the control chamber, respectively; and a filling valve operable in response to the first nozzle control valve selectively to place a high pressure fuel supply line in fluid communication with the control chamber. A biasing means, such as a spring, can be provided for biasing the filling valve to a closed position in which fluid communication between the high pressure supply line and the control chamber is prevented.

The first nozzle control valve can be operable selectively to place the control chamber in fluid communication with a fuel drain. The first nozzle control valve can be in fluid communication with the control chamber via a first restricted pathway. A second nozzle control valve can be provided for controlling fluid flow into and/or out of the control chamber.

The filling valve can comprise a filling valve member having a second restricted pathway. The second restricted pathway can be configured to provide fluid communication across the filling valve member. The second restricted pathway can place the high pressure supply line in fluid communication with a fuel drain (via the first nozzle control valve).

In a yet further aspect of the present invention there is provided a fuel injector for use in delivering fuel to an internal combustion engine, the fuel injector comprising: a nozzle having a valve needle which is moveable with respect to a valve needle seating through a range of movement between a closed position and an open position to control fuel delivery through at least one nozzle outlet, whereby movement of the nozzle needle is controlled by fuel pressure within a control chamber; and first and second nozzle control valves for controlling fuel flow into and out of the control chamber to pressurise and depressurise the control chamber; wherein the fuel injector further comprises a filling valve operable selectively to place a high pressure supply line in fluid communication with the control chamber.

In a still further aspect, the present invention relates to a filling valve comprising a filling valve member having a restricted pathway to establish fluid communication across the filling valve member. The filling valve can be operable in response to a control valve. The filling valve can further comprise a spring for biasing the filling valve member in a first direction. The filling valve can be configured to supply fuel to a control chamber of a fuel injector.

In a further aspect, the present invention relates to a fuel injector for use in delivering fuel to an internal combustion engine, the fuel injector comprising: a nozzle having a valve needle which is moveable with respect to a valve needle seating through a range of movement between a closed position and an open position to control fuel delivery through at least one nozzle outlet, whereby movement of the nozzle needle is controlled by fuel pressure within a control chamber; and first and second nozzle control valves for controlling fuel flow into and out of the control chamber to pressurise and depressurise the control chamber.

In a further aspect, the present invention relates to a method of controlling a fuel injector comprising a nozzle having a valve needle movable between a closed position and an open position in response to fuel pressure within a control chamber; the method comprising selectively operating first and second nozzle control valves to control fuel flow into and out of the control chamber; wherein the first nozzle control valve is selectively operated to open at least one fluid pathway to a drain line to reduce fuel pressure within the control chamber; the first nozzle control valve also being selectively operated to open at least one fluid pathway to a high pressure supply line to increase fuel pressure within the control chamber; and the second nozzle control valve being selectively operated to open at least one fluid pathway to a drain line to reduce fuel pressure within the control chamber.

The method can include the further step of selectively operating said first nozzle control valve and/or said second nozzle control valve to open at least one fluid pathway to a drain line to reduce fuel pressure within the control chamber. A reduction in the pressure within the control chamber can allow the valve needle to open to allow fuel to be injected.

The first and second nozzle control valves can be operated simultaneously or sequentially to control the movement of the valve needle. The simultaneous or sequential operation of the first and second nozzle control valves can be performed to control movement of the valve needle in a first direction from a closed position to an open position; and/or a second direction from an open position to a closed position.

The first nozzle control valve and/or the second nozzle control valve can be operated to control the speed at which the valve needle travels. The speed of valve needle travel can be varied as it travels in said first direction and/or said second direction, for example to control damping. To reduce the speed of the valve needle, the first nozzle control valve or the second nozzle control valve can be operated to close a communication pathway between the control chamber and a fuel drain as the valve needle travels between said closed position and said open position (in said first or second directions).

The method can also include the step of selectively operating said first nozzle control valve and/or said second nozzle control valve to open at least one fluid pathway to a high pressure supply line to increase fuel pressure within the control chamber. Increasing the pressure within the control chamber can displace the valve needle to a closed position.

In a further aspect, the present invention relates to a method of controlling a fuel injector comprising a nozzle having a valve needle movable between a closed position and an open position in response to fuel pressure within a control chamber; the method comprising selectively operating first and second nozzle control valves to control fuel flow into and out of the control chamber.

In a still further aspect, the present invention relates to a control system for a fuel injector, the control system configured to implement the method(s) described herein.

The method(s) described herein can be machine-implemented. The method described herein can be implemented on a computational device comprising one or more processors, such as an electronic microprocessor. The processor(s) can be configured to perform computational instructions stored in memory or in a storage device. The device described herein can comprise one or more processors configured to perform computational instructions.

In a further aspect the present invention relates to a computer system comprising: programmable circuitry; and software encoded on at least one computer-readable medium to program the programmable circuitry to implement the method described herein.

According to a still further aspect the present invention relates to one or more computer-readable media having computer-readable instructions thereon which, when executed by a computer, cause the computer to perform all the steps of the method(s) described herein.

BRIEF DESCRIPTION OF DRAWINGS

An embodiment of the present invention will now be described, by way of example only, with reference to the accompanying figures, in which.

DETAILED DESCRIPTION OF INVENTION

The present invention relates to a fuel injector 1 for supplying high pressure diesel fuel to an internal combustion engine (not shown). Embodiments of the present invention will be described with reference to FIGS. 1 to 5.

Figure 1:
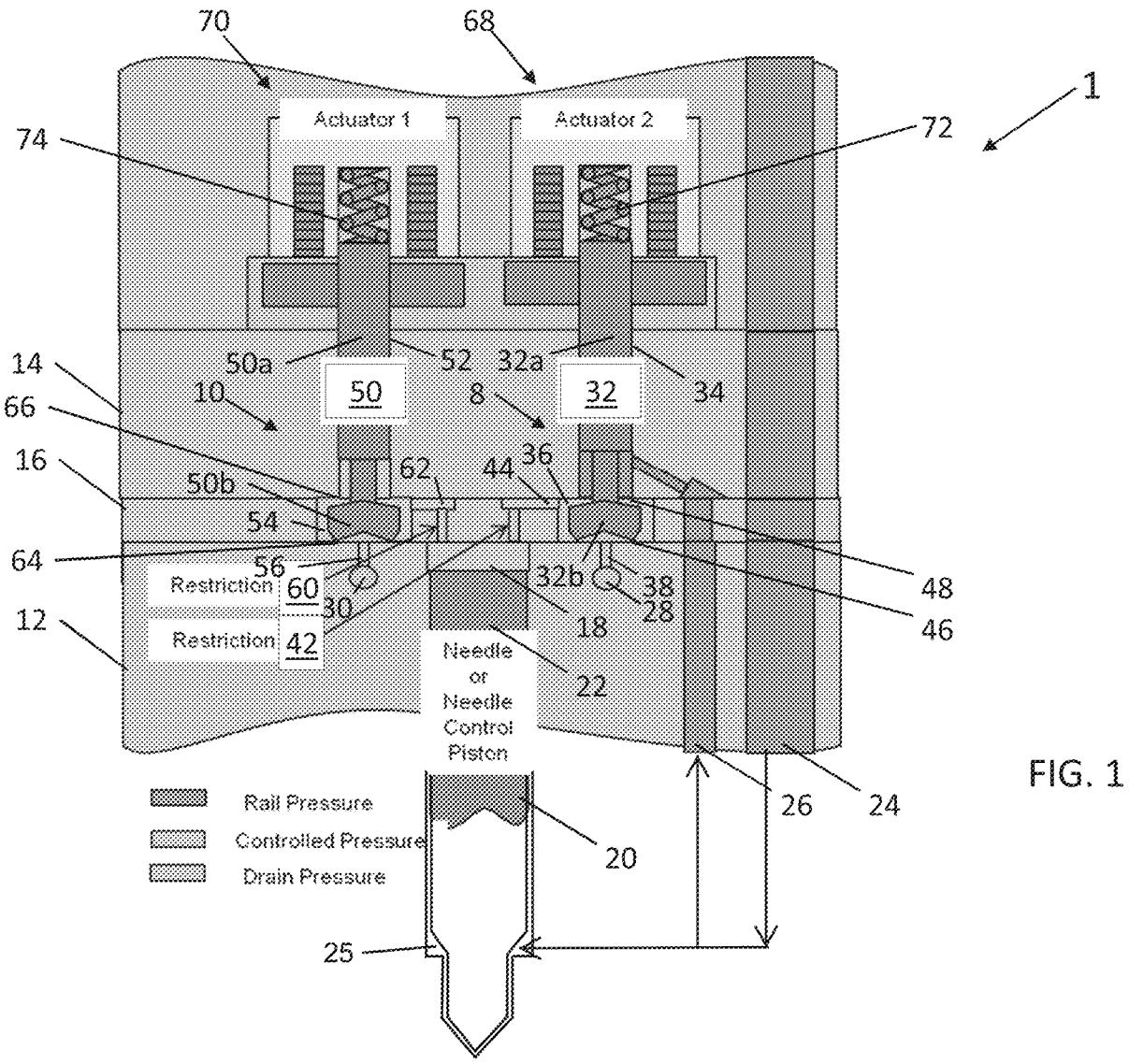
FIG. 1 shows a schematic representation of an injector according to a first embodiment of the present invention.

A schematic view of a fuel injector 1 according to a first embodiment of the present invention is shown in FIG. 1. The fuel injector 1 is suitable for delivering fuel to an engine cylinder or other combustion space of an internal combustion engine. The fuel injector comprises an injector nozzle and first and second nozzle control valves 8, 10. The injector nozzle includes an injector body or injector housing 12. The first and second nozzle control valves 8, 10 are housed within a valve housing 14 and a shim plate 16, which spaces apart the injector body 12 and the nozzle housing 14.

The injector nozzle further includes a valve needle which is operable by means of the first and second nozzle control valves 8, 10 to control fuel flow into an associated combustion space (not shown) through nozzle outlet openings. A lower part of the valve needle is not shown, but terminates in a valve tip which is engageable with a valve needle seat so as to control fuel delivery through the outlet openings into the combustion space. A spring may also be provided for biasing the valve needle towards the valve needle seat.

As can be seen in FIG. 1, an upper end 20 of the valve needle remote from the outlet openings is located within a control chamber 18 defined within the injector body 12. The upper end of the valve needle may be referred to as the "needle piston" 20, sliding movement of which is guided within a guide bore 22 provided in the injector body 12. The needle piston 20 may be integral with the lower part of the valve needle, but alternatively may be a separate part carried by the valve needle.

In use, fuel under high pressure is delivered from a first fuel supply passage 24 to a nozzle chamber 25 within which the lower part of the valve needle is located. It should be noted that first fuel supply passage 24 is in constant fluid communication with nozzle chamber 25 and fuel pressure within the nozzle chamber 25 urges the valve needle toward the open position. From the nozzle chamber, high pressure fuel is able to flow through the outlet openings of the nozzle when the valve needle is moved away from the valve needle seat.

The control chamber 18 is located axially in line with and above the needle piston 20 in the orientation shown in FIG. 1. The control chamber 18 is defined within the injector body 12 in part by the guide bore 22 and in part by an end surface of the needle piston 20, and is closed by the lower surface of the shim plate 16. Fuel pressure within the control chamber 18 applies a force to the needle piston 20, which serves to urge the needle piston 20 in a downward direction and, hence, serves to urge the valve needle against the valve needle seat to prevent fuel injection through the outlet openings. Fuel under high pressure is delivered from a second fuel supply passage 26 to the control chamber 18 via the first nozzle control valve 8. It should be noted that second fuel supply passage 26 is in fluid communication with first fuel supply passage 24 and nozzle chamber 25. A restriction or throttle could optionally be placed between the second fuel supply passage 26 and the first nozzle control valve 8 to control filling of the control chamber 18.

In use, with high pressure fuel supplied to the nozzle chamber 25 through the supply passage 24, an upwards force is applied to a thrust surface or surfaces of the valve needle which serves to urge the valve needle away from the valve needle seat. If fuel pressure within the control chamber 18 is reduced sufficiently, the upwards force acting on the thrust surface due to fuel pressure within the nozzle chamber 25, in addition to the force from the gas pressure in the combustion chamber acting on the tip of the valve needle, is sufficient to overcome the downwards force acting on the end surface of the needle piston 20, and the force on the valve needle provided by the spring (the spring pre-load force). The valve needle therefore lifts away from the valve needle seat to commence fuel injection through the nozzle outlets. If fuel pressure within the control chamber 18 is increased, the force acting to lift the valve needle away from the valve needle seat is overcome by the increased force due to fuel pressure in the control chamber 18 and the valve needle is seated. Thus, by controlling fuel pressure within the control chamber 18, initiation and termination of fuel injection through the outlet openings can be controlled.

The pressure of fuel within the control chamber 18 is controlled by means of the first and second nozzle control valves 8, 10. In the present embodiment the first nozzle control valve 8 is a balanced three-way valve for selectively controlling the flow of fuel to the control chamber 18 from the second supply passage 26; and the flow of fuel from the control chamber 18 to a first low pressure drain 28. The second nozzle control valve 10 is a balanced two-valve for selectively controlling the flow of fuel from the control chamber 18 to a second low pressure drain 30. The first and second nozzle control valves 8, 10 will now be described in greater detail.

The first nozzle control valve 8 includes a first valve pin 32 including an upper portion 32*a* and a lower portion 32*b*. The upper portion of the first valve pin 32, referred to as the first guide portion 32*a*, is slidable within a first guide bore 34 defined in the housing 14. The lower portion of the first valve pin 32, referred to as the first valve head 32*b*, is located and slidable within a first chamber 36 defined within the shim plate 16, and moves in sympathy with the first guide portion 32*a*. The injector body 12, adjacent to the lower face of the shim plate, is provided with a first drain passage 38 which opens into the first chamber 36. The first drain passage 38 communicates with the first low pressure drain 28. The shim plate 16 is provided with a first axial through-drilling 42, and a first cross slot 44 on its upper face which communicates with the first axial drilling 42 at its uppermost end and thereby provides a pathway between the control chamber 18 and the first chamber 36. The first axial drilling 42 has a reduced diameter to form a first restricted pathway to the control chamber 18.

The upper face of the injector body 12 defines a first valve seat 46 for the head portion 32*b* of the first valve pin 32. The head portion 32*b* of the first valve pin 32 is engaged with the first valve seat 46 when the first valve pin is moved into a first valve position, in which communication between the control chamber 18 and the first drain passage 38 is broken and communication between the first chamber 36 and the second supply passage 26 is open. The housing 14 defines, at its lower surface, a second valve seat 48 for the head portion 32*b* of the first valve pin 32. The head portion 32*b* of the first valve pin is engaged with the second valve seat 48 when the first valve pin is moved into a second valve position, in which communication between the second supply passage 26 and the first chamber 36 is broken and communication between the control chamber 18 and the first drain passage 38 is open.

The second nozzle control valve 10 includes a second valve pin 50 including an upper portion 50*a* and a lower portion 50*b*. The upper portion of the second valve pin 50, referred to as the second guide portion 50*a*, is slidable within a second guide bore 52 defined in the housing 14. The lower portion of the second valve pin 50, referred to as the second valve head 50*b*, is located and slidable within a second chamber 54 defined within the shim plate 16, and moves in sympathy with the second guide portion 50*a*. The injector body 12, adjacent to the lower face of the shim plate, is provided with a second drain passage 56 which opens into the second chamber 54. The second drain passage 56 communicates with the second low pressure drain 30. The shim plate 16 is provided with a second axial through-drilling 60, and a second cross slot 62 on its upper face which communicates with the second axial drilling 60 at its uppermost end and thereby provides a pathway between the control chamber 18 and the second chamber 54. The second axial drilling 60 has a reduced diameter to form a second restricted pathway to the control chamber 18.

By way of example, the first axial drilling 42 can have a diameter of between 0.05 mm and 0.3 mm. The diameter of the second axial drilling 60 is typically sized to provide a cross-sectional area between half and twice the area of the first axial drilling 42. It will be appreciated that the dimensions may vary depending on the volume of the control chamber 18 and/or the diameter of the valve pins 32, 50. The dimensions will also vary depending on the combustion requirements.

The upper face of the injector body 12 defines a third valve seat 64 for the head portion 50*b* of the second valve pin 50. The head portion 50*b* of the second valve pin 50 is engaged with the third valve seat 64 when the second valve pin is moved into a first valve position, in which communication between the control chamber 18 and the second drain passage 56 is broken. The housing 14 defines, at its lower surface, a fourth valve seat 66 for the second head portion 50*b* of the second valve pin. The head portion 50*b* of the second valve pin is engaged with the fourth valve seat 66 when the second valve pin 50 is moved into a second valve position, in which communication between the control chamber 18 and the second drain passage 56 is open.

The first and second nozzle control valves 8, 10 in the present embodiment are actuated by first and second electromechanical solenoids 68, 70. In particular, the first and second solenoids 68, 70 comprise respective first and second springs 72, 74 for biasing the first and second valve pins towards their respective first positions (i.e. advanced position) in which communication between the control chamber 18 and the first and second drain passages 38 is broken. Actuating (i.e. energizing) the solenoids 68, 70 displaces the first and second valve pins towards their respective second positions (i.e. retracted positions) in which communication between the control chamber 18 and the respective first and second drain passages 38, 56 are open. The first and second nozzle control valves 8, 10 are controlled by an injection control unit (not shown) and can be actuated and de-actuated independently of each other.

In use, when the first nozzle control valve 8 is de-actuated, the first valve pin 32 is advanced to the first valve position such that the head portion 32*b* is in engagement with the first valve seat 46 under the spring force (as shown in FIG. 1). In this position, fuel at high pressure is able to flow from the second supply passage 26 past the second valve seat 48 and into the first chamber 36, from where it can flow into the control chamber 18. Similarly, when the second nozzle control valve 10 is de-actuated, the second valve pin 50 is in its first valve position such that the head portion 50*b* is in engagement with the third valve seat 64. In this position, communication between the control chamber 18 and the second drain passage 56 is broken, thereby preventing fuel flow from the control chamber 18 to the second drain passage 56. The control chamber 18 is thereby pressurised and the needle piston 20 is urged downwards, hence the valve needle is urged downwards against the valve needle seat so that injection through the outlet openings does not occur.

When the first control valve 8 is actuated, that is when the first valve pin 32 is moved away from the first valve seat 46 into engagement with the second valve seat 48, high pressure fuel within the second supply passage 26 is no longer able to flow past the second valve seat 48 to the control chamber 18. Instead, fuel within the control chamber 18 is able to flow past the first valve seat 46 into the first drain passage 38 to the first low pressure drain 28. It should be noted that when the first valve pin 32 is moved into engagement with the second valve seat 48, fluid communication between the nozzle chamber 25 and the control chamber 18 is prevented and fluid communication between nozzle chamber 25 and the first drain passage 38/the first low pressure drain 28 is prevented. Similarly, when the second control valve 10 is actuated, that is when the second valve pin 50*a*, 50*b* is moved away from the third valve seat 64 into engagement with the fourth valve seat 66, fuel within the control chamber 18 is able to flow past the third valve seat 64 into the second drain passage 56 to the second low pressure drain 30. Fuel pressure within the control chamber 18 is therefore reduced and the control chamber 18 is depressurised. As a result, the valve needle is urged upwards away from the valve needle seat due to the force of fuel pressure within the nozzle chamber acting on the thrust surface of the valve needle. As outlined above, the first and second axial drillings 42, 60 form first and second restricted pathways. The restricted pathways control the rate of fuel flow out of the control chamber 18 and thereby control the rate at which the valve needle is displaced upwards from the valve needle seat.

Controlling actuation and/or de-actuation of the first and second nozzle control valves 8, 10 enables a range of operating modes for controlling the valve needle as it travels between said open and closed positions (in one or both directions of travel). By way of example, when controlling the valve needle as it travels from said closed position to said open position, the injector 1 according to the present embodiment provides the following operating modes:

First nozzle control valve 8 de-actuated and the second nozzle control valve 10 actuated. The control pressure in the control chamber 18 decays depending on the ratio of the diameters of the first and second axial drillings 42, 60. The valve needle lifts at a relatively low velocity controlled by the diameter of the second axial drilling 60.

First nozzle control valve 8 actuated and the second nozzle control valve 10 de-actuated. The control pressure in the control chamber 18 decays depending on the diameter of the first axial drilling 42. The valve needle lifts at a medium velocity controlled by the diameter of the first axial drilling 42.

First and second nozzle control valves 8, 10 both actuated. The control pressure in the control chamber 18 decays depending on the diameter of the first and second axial drillings 42, 60 in parallel. The valve needle lifts at a relatively high velocity controlled by the diameter of the first and second axial drillings 42, 60 in parallel.

Second nozzle control valve 10 actuated followed by actuation of the first nozzle control valve 8. The control pressure in the control chamber 18 decays depending on the ratio of the diameters of the first and second axial drillings 42, 60. The valve needle lifts at a relatively low velocity initially and then at a higher velocity (providing a "boot" shaped injection).

First and second nozzle control valves 8, 10 actuated followed by de-actuation of the second nozzle control valve 10. The valve needle lifts at a relatively high velocity initially and then at a lower velocity. This can help to avoid excessive needle lift when controlling multiple injections and can limit the impact velocity of the valve needle on the top stop.

In all of the operating modes described above, the valve needle closes at a velocity determined at least partially by the diameter of the first axial drilling 42. It will be appreciated that other operating modes can be implemented by choosing different valve synchronisations. The injector control unit can be programmed with an appropriate instruction set to control the actuation and/or de-actuation of the first and second nozzle control valves 8, 10. These operating modes are applicable to some or all of the embodiments of the injector 1 described herein.

Figure 2:
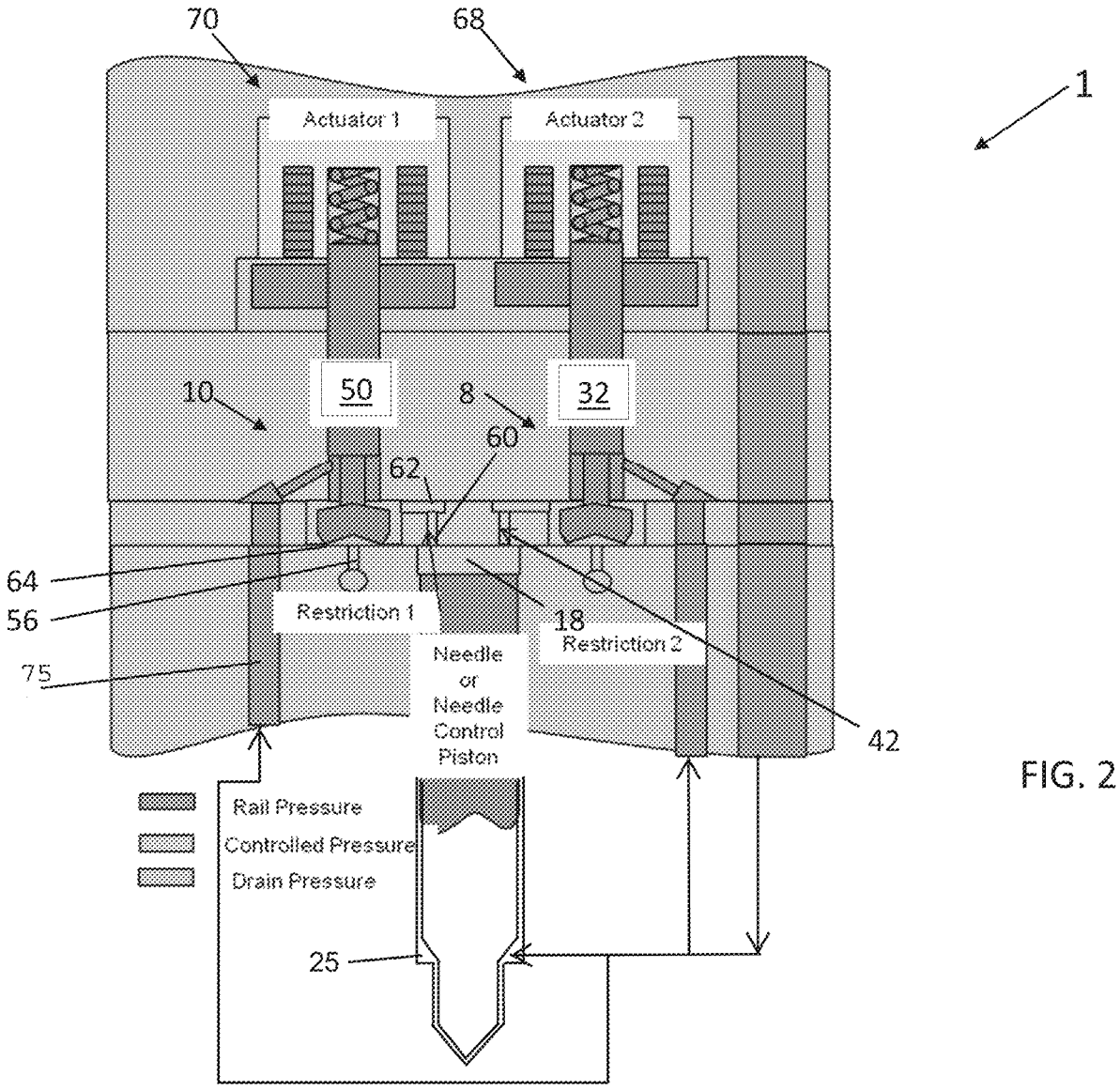
FIG. 2 shows a schematic representation of an injector according to a second embodiment of the present invention.

A second embodiment of the fuel injector 1 according to the present invention is shown in FIG. 2. The second embodiment is a modified version of the first embodiment and like reference numerals are used herein for like components. The injector 1 comprises a first nozzle control valve 8 including a balanced three-way valve; and a second nozzle control valve 10 including a balanced three-way valve. The first and second nozzle control valves 8, 10 can be operated independently of each other to fill and drain the control chamber 18. The arrangement of the first nozzle control valve 8 is the same as that of the first embodiment.

The second nozzle control valve 10 is modified to provide a balanced three-way valve for selectively controlling the flow of fuel from a third fuel supply passage 75 to a control chamber 18. It should be noted that third fuel supply passage 75 is in fluid communication with the first fuel supply passage 24 and the nozzle chamber 25. This arrangement allows fuel under high pressure to be delivered from the third fuel supply passage 75 to the control chamber 18 via the second nozzle control valve 10. Specifically, when a second valve pin 50 is moved into a first valve position, communication between the control chamber 18 and a second drain passage 56 is broken and communication between the second chamber 54 and the third supply passage 75 is opened. Conversely, when the second valve pin 50 is moved into a second valve position, communication between the third supply passage 75 and the first chamber 36 is broken and communication between the control chamber 18 and the second drain passage 56 is opened. It should be noted that when both the first nozzle control valve 8 and the second nozzle control valve 10 are positioned to prevent fluid communication with their respective drains 38, 56, fluid communication is prevented between the nozzle chamber 25 and the control chamber 18 and fluid communication is prevented between the nozzle chamber 25 and drains 38, 56. A restriction or throttle could optionally be placed between the third fuel supply passage 75 and the second nozzle control valve 10 to control filling of the control chamber 18.

The provision of a third supply passage 75 means that two filling paths are available for supplying high pressure fuel to the control chamber 18. With both filling paths open (i.e. the first and second valve pins 32, 50 in their respective first positions, as shown in FIG. 2), the filling rate could be increased, potentially doubled. However, rather than provide an increased filling rate, the diameters of the first and second axial drillings 42, 60 are smaller than the first axial drilling 42 in the first embodiment. This reduces the valve lift required for each of the first and second nozzle control valves 8, 10, thereby reducing the lifting force required by the first and second solenoids 68, 70. Moreover, reducing the diameters of the first and second axial drillings 42, 60 reduces the direct through-flow losses that occur when one of the nozzle control valves 8, 10 is actuated and the other is de-actuated.

Figure 3:
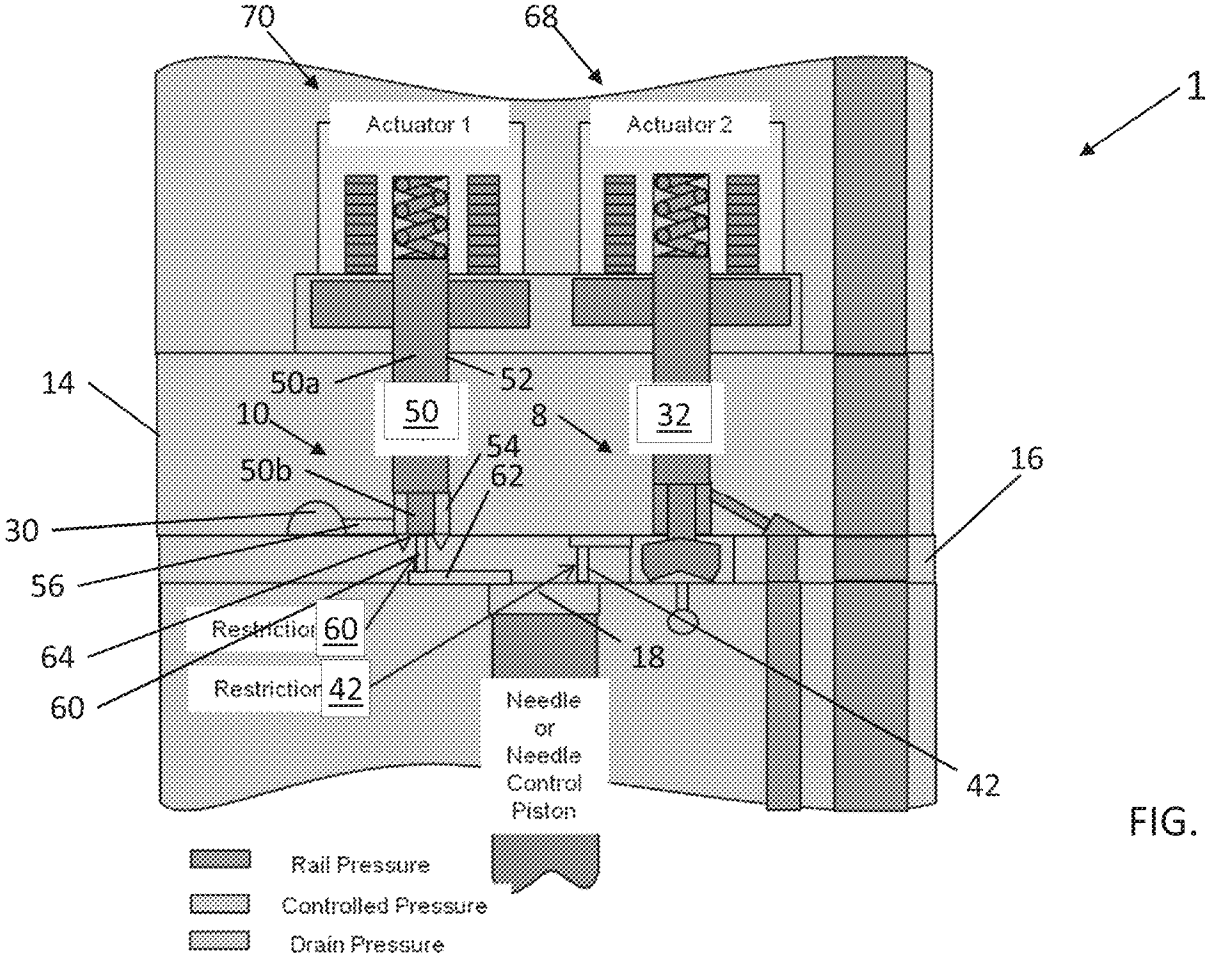
FIG. 3 shows a schematic representation of an injector according to a third embodiment of the present invention.

A third embodiment of the fuel injector 1 according to the present invention is shown in FIG. 3. The third embodiment is a further modified version of the first embodiment and like reference numerals are used herein for like components. The arrangement of the first nozzle control valve 8 is the same as that of the first embodiment. Also, while not shown, the third embodiment includes the same interconnection between the first fuel supply passage 24, the second fuel supply passage 26, and the nozzle chamber 25 as in the first embodiment.

The first nozzle control valve 8 includes a balanced three-way valve; and the second nozzle control valve 10 includes an un-balanced two-way valve. The second nozzle control valve 10 comprises a second valve pin 50 including an upper portion 50*a* and a lower portion 50*b*. The upper portion of the second valve pin 50, referred to as the second guide portion 50*a*, is slidable within a second guide bore 52 defined in the housing 14. The lower portion of the second valve pin, referred to as the second valve head 50*b*, is located within a second chamber 54 also defined in the housing 14, and moves in sympathy with the second guide portion 50*a*. A second drain passage 56 is provided in the housing 14, adjacent to the upper face of the shim plate 16, and opens into the second chamber 54. The second drain passage 56 communicates with the second low pressure drain 30. The shim plate 16 is provided with a second axial through-drilling 60, and a second cross slot 62 on its lower face communicates with the second axial drilling 60 at its lowermost end and thereby provides a pathway between the control chamber 18 and the second chamber 54. The second axial drilling 60 has a reduced diameter to form a second restricted pathway.

The upper face of the shim plate 16 defines a third valve seat 64 for the head portion 50*b* of the second valve pin. The head portion 50*b* of the second valve pin is engaged with the third valve seat 64 when the second valve pin 50 is moved into a first valve position, in which communication between the control chamber 18 and the second drain passage 56 is broken.

The operation of the injector 1 according to the third embodiment is unchanged from the first embodiment comprising first and second balanced valves 8, 10. However, utilising an unbalanced valve for the second nozzle control valve 10 reduces static leakage resulting from the provision of a second nozzle control valve 10. Moreover, a parasitic filling flow for the two-way valve in the second nozzle control valve 10 can be avoided as filling is provided by the first nozzle control valve 8.

The actuation forces required for the second nozzle control valve 10 in the third embodiment are higher than those required for the balanced valve utilised in the first and second embodiments. However, the small diameter of the second axial drilling 60 in the third embodiment reduces the required actuation force. Accordingly, a smaller, faster second solenoid 70 can be employed than in prior art injectors.

The fuel injector 1 according to the third embodiment could be modified to provide a restriction or throttle between the second fuel supply passage 26 and the first nozzle control valve 8. The restriction could control filling of the control chamber 18.

Figure 4:
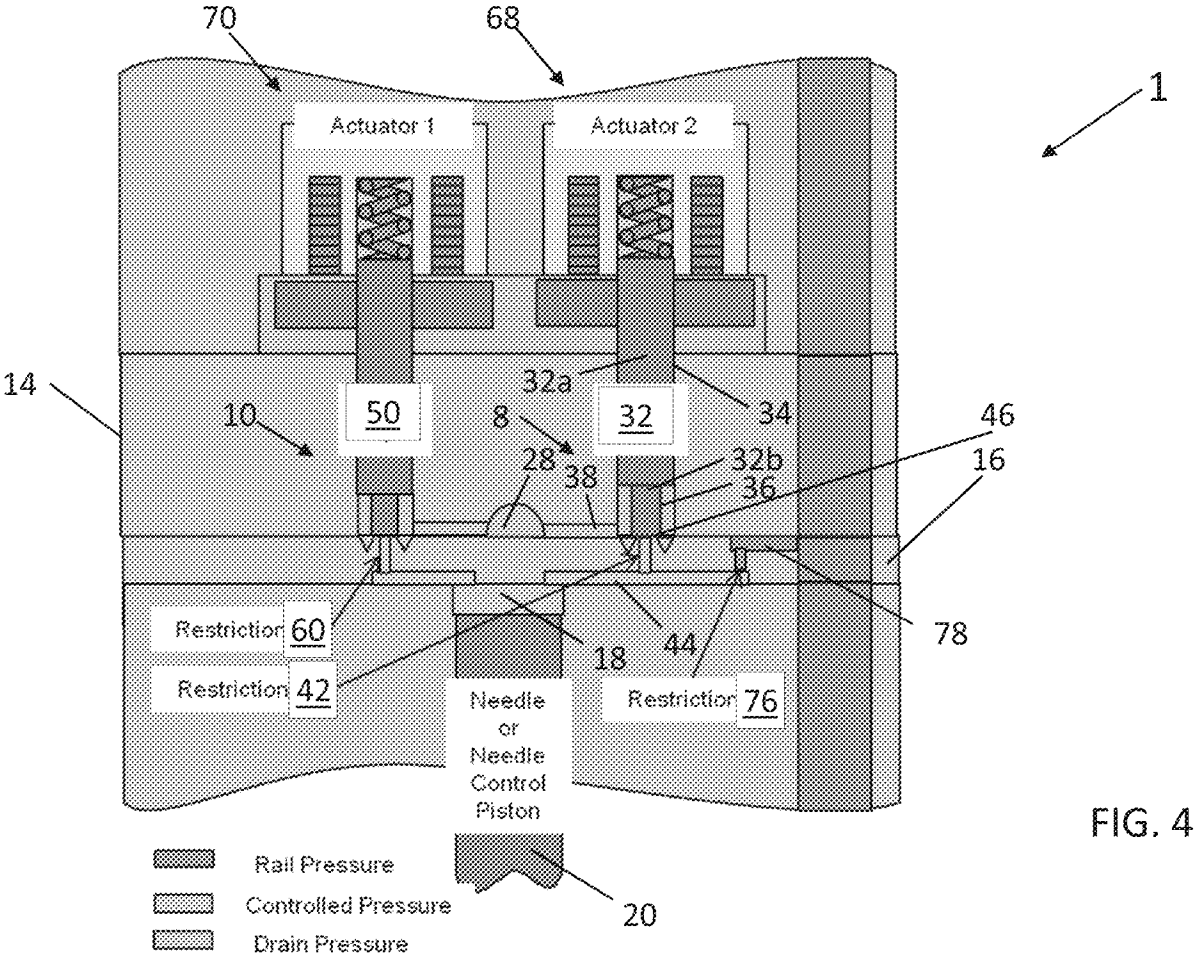
FIG. 4 shows a schematic representation of an injector according to a fourth embodiment of the present invention.

A fourth embodiment of the fuel injector 1 according to the present invention is shown in FIG. 4. The fourth embodiment is a modified version of the third embodiment and like reference numerals are used herein for like components. The injector 1 comprises a first nozzle control valve 8 including an un-balanced two-way valve; and a second nozzle control valve 10 including an un-balanced two-way valve. The arrangement of the second nozzle control valve 10 is the same as that of the third embodiment. The first nozzle control valve 8 and/or the second nozzle control valve 10 can be used to drain the control chamber 18.

The first nozzle control valve 8 includes a first valve pin 32 including an upper portion 32*a* and a lower portion 32*b*. The upper portion of the first valve pin, referred to as the first guide portion 32*a*, is slidable within a first guide bore 34 defined in the housing 14. The lower portion of the first valve pin, referred to as the first valve head 32*b*, is located and slidable within a first chamber 36 defined within the housing 14, and moves in sympathy with the first guide portion 32*a*. A first drain passage 38 is provided in the housing 14, adjacent to the upper face of the shim plate 16, and opens into the first chamber 36. The first drain passage 38 communicates with a common low pressure drain 28. The shim plate 16 is provided with a first axial through-drilling 42, and a first cross slot 44 on its lower face which communicates with the first axial drilling 42 at its lowermost end and thereby provides a pathway between the control chamber 18 and the first chamber 36. The first axial drilling 42 has a reduced diameter to form a first restricted pathway to the control chamber 18.

A third axial through-drilling 76 is provided in the shim plate 16 and communicates with the first fuel supply passage 24 via a second cross slot 78 on the upper face of the shim plate 16. The third axial drilling 76 also communicates with the first cross slot 44 on the lower face of the shim plate 16 to form a fluid pathway from the first fuel supply passage 24 to the control chamber 18. The third axial drilling 76 has a reduced diameter to form a third restricted pathway. The filling of the control chamber 18 is determined by the third axial drilling 76

The upper face of the shim plate 16 defines a first valve seat 46 for the head portion 32*b* of the first valve pin. The head portion 32*b* of the first valve pin is engaged with the first valve seat 46 when the first valve pin is moved into a first valve position, in which communication between the control chamber 18 and the first drain passage 38 is broken (as shown in FIG. 4).

The control chamber 18 remains in communication with the fuel supply passage 24 via the third axial drilling 76. The third axial drilling 76 thereby provides a filling flow path for the control chamber 16. The flow rate through the third restriction determines needle valve closing velocity. This arrangement allows two two-way valves to be used which can be configured to be statically leakless and obviate the need for high temperature leakage along the close clearance valve stem (i.e. past the first and second guide portions 32*a*, 50*a*). The task of dissipating the filling flow in order to start injection can be performed by the first and second nozzle control valves 8, 10 in parallel. The first and second solenoids 68, 70 can therefore be designed to provide a lower actuating force. In use, multiple injections can be controlled by only one of the solenoids 68, 70 or by synchronization of both solenoids 68, 70 to provide increased responsiveness.

As with the previous embodiments described herein, three needle opening velocities can be provided using two different diameters of first and second axial drillings 42, 60 to form the first and second restrictions. Alternatively, if the first and second axial drillings 42, 60 have the same diameter, it is possible to alternate the first and second solenoids 68, 70 to produce well controlled multiple injections. This is because the dwell time between injections for each solenoid 68, 70 is increased. This control technique can also be implemented for the second embodiment of the fuel injector 1 described herein.

Figure 5:
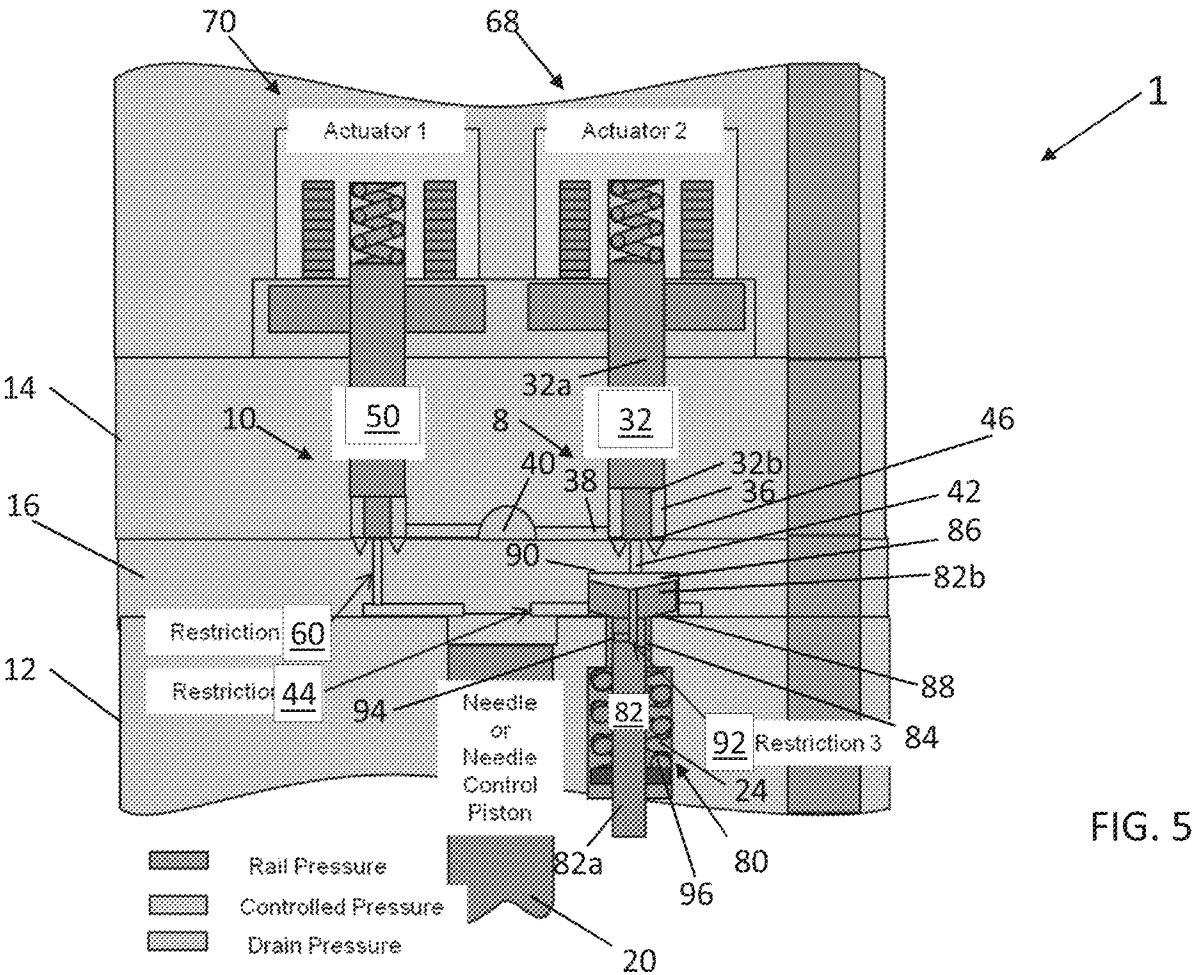
FIG. 5 shows a schematic representation of an injector according to a fifth embodiment of the present invention.

A fifth embodiment of the fuel injector 1 according to the present invention is shown in FIG. 5. The fifth embodiment is a development of the fourth embodiment and like reference numerals are used herein for like components. While not shown, the fifth embodiment includes the same interconnection between the first fuel supply passage 24, the second fuel supply passage 26, and the nozzle chamber 25 as in the first embodiment. The injector 1 comprises a first nozzle control valve 8 including an un-balanced two-way valve; and a second nozzle control valve 10 including an un-balanced two-way valve. The arrangement of the first and second nozzle control valves 8, 10 is the same as that of the fourth embodiment. The first nozzle control valve 8 is used to control filling of the control chamber 18 and the second nozzle control valve 10 is used to control draining of the control chamber 18.

A fill valve 80 is provided to control the supply of high pressure fuel from the first fuel supply passage 24. The fill valve 80 comprises a third valve pin 82 including an upper portion 82*a* and a lower portion 82*b*. The lower portion of the third valve pin 82, referred to as the first stem portion 82*a*, is slidable within a third bore 84 defined in the injector body 12. The third bore 84 has a diameter larger than that of the first stem portion 82*a* to permit fuel flow past the stem portion 82*a*. The upper portion of the third valve pin 82, referred to as the third valve head 82*b*, is located and slidable within a third chamber 86 defined within the shim plate 16, and moves in sympathy with the third guide portion 82*a*. A first axial through-drilling 42 provided in the shim plate 16 provides a communication pathway between the first nozzle control valve 8 and the third chamber 86. A first cross slot 44 on the lower face of the shim plate 16 also communicates with the third chamber 86 and thereby provides a pathway between the control chamber 18 and the first chamber 36. The first cross slot 44 optionally has a reduced cross-sectional area to form a first restricted pathway. The restriction to the communication pathway between the control chamber 18 and the third chamber 86 can optionally be omitted in the present embodiment. The fill valve 80 can be used to stop through flow.

An upper face of the injector body 12 defines a fifth valve seat 88 for engaging a lower surface of the head portion 82*b* of the third valve pin 82. An upper face of the third chamber 86 defines a sixth valve seat 90 for engaging an upper surface of the head portion 82*b* of the third valve pin 82. A third axial drilling 92 is provided through the head portion 82*b* of the third valve pin 82 and communicates with a transverse drilling 94 provided in the first stem portion 82*a*. The third drilling 92 has a reduced diameter to form a third restriction.

The head portion 82*b* of the third valve pin 82 is engaged with the fifth valve seat 88 when the third valve pin is moved into a first valve position (as shown in FIG. 5), in which communication between the control chamber 18 and the third chamber 86 is broken. The head portion 82*b* of the third valve pin 82 is engaged with the sixth valve seat 90 when the third valve pin is moved into a second valve position, in which communication between the control chamber 18 and the third chamber 86 is open. A third spring 96 is provided to bias the third valve pin 82 towards the first valve position even when the pressure in the control chamber 18 is high. The third drilling 92 and the transverse drilling 94 provide a restricted communication pathway between the third chamber 86 and the first fuel supply passage 24.

In use, the third valve pin 82 is controlled by the first nozzle control valve 8. When the first nozzle control valve 8 is de-actuated, the first valve pin 32 moves to a first advanced position under spring force. A head portion 32*b* of the first valve pin 32 seats on a first valve seat 46 provided on the upper face of the shim plate 16 and communication between the third chamber 86 and the first drain passage 38 is broken (as shown in FIG. 5). The fuel pressure within the third chamber 86 increases and matches the fuel pressure in the first fuel supply passage 24. When the pressure differential across the head portion 82*b* of the third valve pin 82 is reduced sufficiently, the third spring 96 biases the third valve pin 82 towards its first valve position and communication between the control chamber 18 and the first fuel supply passage 24 is broken (as shown in FIG. 5). When the third valve pin 82 is in its first position there is no filling flow to the control chamber 18, but the control chamber 18 remains pressurised so long as the second nozzle control valve 10 remains closed. This arrangement enables the needle piston 20 to be locked at part lift. Subsequently opening the second nozzle control valve 10 causes the needle piston 20 to lift further.

Actuating the first nozzle control valve 8 moves the first valve pin 32 to a second retracted position. A head portion 32*b* of the first valve pin 32 lifts from the first valve seat 46 establishing communication between the third chamber 86 and the first drain passage 36. The fuel pressure within the third chamber 86 decreases until the third spring 96 is no longer able to overcome the pressure differential across the head portion 82*b* of the third valve pin 82. The third valve pin 82 then travels to its second position providing communication between the control chamber 18 and the first fuel supply passage 24. The control chamber 18 is thereby pressurised and the needle piston 20 is urged downwards, hence the valve needle is urged downwards against the valve needle seat so that injection through the outlet openings does not occur. Thus, opening the first nozzle control valve 8 causes the needle piston 20 to close.

The injector 1 according to the fifth embodiment uses the first and second nozzle control valves 8, 10 to provide switchable needle opening characteristics. This arrangement is statically leakless and only a very low flow through the third restriction occurs while the filling valve 80 is open. Moreover, the filling valve 80 only needs to be open during the re-closure of the valve needle 20.

The injector 1 can provide fast opening of the valve needle 20 by actuating the second nozzle control valve 10 to open the pathway to the first drain passage 38. Maintaining the first nozzle control valve 8 in a closed position prevents the filling valve 80 from opening, thereby preventing the supply of fuel from the first fuel supply passage 24 to the control chamber 18.

To end injection from the nozzle, the first nozzle control valve 8 is actuated. By synchronising the timing of actuating the first nozzle control valve 8, fine control of the needle valve 20 is possible to facilitate injection of small volumes of fuel. For longer injections, opening of the needle valve 20 can be stopped by de-actuating the second nozzle control valve 10 and stopping the drain flow. This control sequence could be implemented to stop the valve needle 20 at low restrictive needle lift or to slow the valve needle 20 to reduce stop impact.

It will be appreciated that various changes and modifications can be made to the embodiment described herein without departing from the scope of the present invention. For example, the first nozzle control valve 8 can be in fluid communication with the high pressure supply line via a first restricted inlet pathway. The second nozzle control valve 10 can be in fluid communication with the control chamber via a second restricted inlet pathway. The supply of high pressure fuel to the first nozzle control valve 8 and/or the second nozzle control valve 10 can thereby be controlled (or throttled). In certain embodiments, the filling of the control chamber can be achieved without compromising drainage to a low pressure drain.

We claim:

1. A fuel injector for use in delivering fuel to an internal combustion engine, the fuel injector comprising:

a nozzle having a valve needle which is moveable with respect to a valve needle seating through a range of movement between a closed position and an open position to control fuel delivery through at least one nozzle outlet, whereby movement of the valve needle is controlled by fuel pressure within a control chamber; and first and second nozzle control valves for controlling fuel flow into and out of the control chamber to pressurise and depressurise the control chamber;

wherein said first nozzle control valve is operable selectively to place the control chamber in fluid communication with a first fuel drain;

said first nozzle control valve also being operable selectively to place the control chamber in fluid communication with a high pressure supply line;

said second nozzle control valve being operable selectively to place the control chamber in fluid communication with a second fuel drain; and said second nozzle control valve is operable to place the control chamber in fluid communication with the high pressure supply line.

2. A fuel injector as claimed in claim 1, wherein said first nozzle control valve is in fluid communication with the control chamber via a first restricted pathway; and/or the second nozzle control valve is in fluid communication with the control chamber via a second restricted pathway.

3. A fuel injector as claimed in claim 2, wherein the first restricted pathway comprises a first restriction and the second restricted pathway comprises a second restriction; the cross-sectional areas of the first and second restrictions being the same or different.

4. A method of controlling a fuel injector comprising a nozzle having a valve needle movable between a closed position and an open position in response to fuel pressure within a control chamber; the method comprising selectively operating first and second nozzle control valves to control fuel flow into and out of the control chamber;

wherein the first nozzle control valve is selectively operated to open a first fluid pathway to a first drain line to reduce fuel pressure within the control chamber;

the first nozzle control valve is also selectively operated to open a second fluid pathway to a high pressure supply line to increase fuel pressure within the control chamber;

the second nozzle control valve being selectively operated to open a third fluid pathway to a second drain line to reduce fuel pressure within the control chamber; and the second nozzle control valve is also operated to place the control chamber in fluid communication with the high pressure supply line to increase fuel pressure within the control chamber.

5. A method as claimed in claim 4, wherein the first and second nozzle control valves are operated simultaneously or sequentially to control the movement of the valve needle.

6. A method as claimed in claim 5 further comprising the step of subsequently operating one of said first and second nozzle control valves to control the movement of the valve needle.

7. A method as claimed in claim 4, further comprising the step of selectively operating said second nozzle control valve to open a fourth fluid pathway to the high pressure supply line to increase fuel pressure within the control chamber.

8. A control system for a fuel injector, the control system configured to implement the method claimed in claim 4.

9. A fuel injector for use in delivering fuel to an internal combustion engine, the fuel injector comprising:

a nozzle having a valve needle which is moveable with respect to a valve needle seating through a range of movement between a closed position and an open position to control fuel delivery through at least one nozzle outlet, whereby movement of the valve needle is controlled by fuel pressure within a control chamber and within a nozzle chamber, wherein the nozzle chamber is in constant fluid communication with a high pressure supply line, wherein fuel pressure within the control chamber urges the valve needle toward the closed position, and wherein fuel pressure within the nozzle chamber urges the valve needle toward the open position; and first and second nozzle control valves for controlling fuel flow into and out of the control chamber to pressurise and depressurise the control chamber;

wherein said first nozzle control valve is operable selectively to place the control chamber in fluid communication with a first fuel drain;

said first nozzle control valve also is operable selectively to place the control chamber in fluid communication with the high pressure supply line and the nozzle chamber;

said second nozzle control valve is operable selectively to place the control chamber in fluid communication with a second fuel drain; and said second nozzle control valve is operable to place the control chamber in fluid communication with the high pressure supply line said first nozzle control valve is operable to prevent fluid communication between said nozzle chamber and said control chamber when fluid communication is provided between said control chamber and said first fuel drain.

10. A fuel injector as claimed in claim 9, wherein said first nozzle control valve is operable to prevent fluid communication between said nozzle chamber and said first fuel drain when fluid communication is provided between said control chamber and said first fuel drain.

11. A fuel injector as claimed in claim 9, wherein:

said second nozzle control valve is operable to place the control chamber in fluid communication with the high pressure supply line; and said first and second nozzle control valves are operable to prevent fluid communication between said nozzle chamber and said control chamber when fluid communication is provided between said control chamber and said second fuel drain.

12. A fuel injector as claimed in claim 11, wherein said first and second nozzle control valves are operable to prevent fluid communication between said nozzle chamber and said first fuel drain and between said nozzle chamber and said second fuel drain when fluid communication is provided between said control chamber and said first fuel drain and between said control chamber and said second fuel drain.

* * * * *